US008069923B2

(12) United States Patent
Blanco et al.

(10) Patent No.: US 8,069,923 B2
(45) Date of Patent: Dec. 6, 2011

(54) TOP SUCTION FLUID END

(75) Inventors: Ivan Blanco, Duncan, OK (US); Stanley Stephenson, Duncan, OK (US); David Stribling, Duncan, OK (US); Larry Guffee, Frisco, TX (US); Greg MaCauely, Duncan, OK (US)

(73) Assignee: Halliburton Energy Services Inc., Duncan, OK (US)

( * ) Notice: Subject to any disclaimer, the term of this patent is extended or adjusted under 35 U.S.C. 154(b) by 512 days.

(21) Appl. No.: 12/190,411

(22) Filed: Aug. 12, 2008

(65) Prior Publication Data

US 2010/0038070 A1 Feb. 18, 2010

(51) Int. Cl.
*E21B 43/25* (2006.01)

(52) U.S. Cl. ..... 166/305.1; 166/90.1

(58) Field of Classification Search ..... 166/305.1, 166/308.1, 90.1; 417/904
See application file for complete search history.

(56) References Cited

U.S. PATENT DOCUMENTS

| | | | | |
|---|---|---|---|---|
| 2,023,559 | A | 12/1935 | Wainford | |
| 2,766,701 | A * | 10/1956 | Giraudeau | 417/568 |
| 3,022,742 | A | 2/1962 | Bowen, Jr. | |
| 4,007,921 | A | 2/1977 | Zingg | |
| 4,989,987 | A | 2/1991 | Berryman et al. | |
| 5,246,355 | A | 9/1993 | Matzner et al. | |
| 5,690,478 | A | 11/1997 | Zöllner | |
| 6,168,398 | B1 | 1/2001 | Handtmann | |
| 6,637,517 | B2 * | 10/2003 | Samuel et al. | 166/381 |
| 6,742,441 | B1 | 6/2004 | Surjaatmadja et al. | |
| 6,859,740 | B2 | 2/2005 | Stephenson et al. | |
| 7,090,017 | B2 * | 8/2006 | Justus et al. | 166/308.1 |
| 7,100,688 | B2 | 9/2006 | Stephenson et al. | |
| 7,353,875 | B2 | 4/2008 | Stephenson et al. | |
| 2002/0139524 | A1 * | 10/2002 | Erick | 166/63 |
| 2004/0219042 | A1 * | 11/2004 | Kugelev et al. | 417/454 |
| 2006/0088423 | A1 | 4/2006 | Brunet et al. | |
| 2006/0088425 | A1 | 4/2006 | Lucas et al. | |

FOREIGN PATENT DOCUMENTS

| | | | |
|---|---|---|---|
| GB | 2118257 | * | 10/1983 |
| GB | 2118257 A | | 10/1983 |

OTHER PUBLICATIONS

Foreign communication from a related counterpart application—Internatiional Search Report and Written Opinion, PCT/GB2009/001876.*

Foreign communication from a related counterpart application—International Preliminary Report on Patentability, PCT/GB2009/001876, Feb. 15, 2011, 9 pages.

Foreign communication from a related counterpart application—International Search Report and Written Opinion, PCT/GB2009/001876, Mar. 3, 2010, 13 pages.

* cited by examiner

*Primary Examiner* — Hoang Dang
(74) *Attorney, Agent, or Firm* — John W. Wustenberg; Conley Rose, P.C.

(57) ABSTRACT

A positive displacement wellbore servicing pump having a power end and a fluid end is disclosed. The fluid end has a main chamber and a suction bore in fluid connection with the main chamber and the suction bore has a suction central axis vector. A discharge bore is in fluid connection with the main chamber and the discharge bore has a discharge central axis vector. A portion of the suction central axis vector is vertically higher than any portion of the discharge central axis vector. A method of providing a wellbore servicing fluid to a wellbore is also disclosed. A method of providing a wellbore servicing fluid to a fluid end of a positive displacement pump is also disclosed.

20 Claims, 9 Drawing Sheets

TOP SUCTION FLUID END

CROSS-REFERENCE TO RELATED APPLICATIONS

Not applicable

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

Embodiments described herein relate to positive displacement pumps, and more specifically to devices and methods to improve the efficiency, durability, performance, and operating characteristics of reciprocating positive displacement pumps (of the sort that might be used in pumping wellbore servicing fluids).

BACKGROUND

Positive displacement pumps, and specifically reciprocating pumps, are used in all phases of oilfield operation to pump water, cement, fracturing fluids, and other stimulation or servicing fluids. Pumps in oilfield operations often endure harsh conditions, especially when pumping abrasive fluids (such as fracturing fluids). Another problem with conventional positive displacement pumps is that proppants tend to settle from the fluid being pumped when optimal pumping velocities are not maintained in pumping systems. Still another problem with conventional positive displacement pumps is that when the conventional pumping systems are not properly tuned with an accumulator, pressure variations tend to cause cavitation within the pumping system. Further, conventional positive displacement pumps having a suction side of a fluid end located on a lower side of the pump pose a particularly difficult and cumbersome job when the components of the suction side of the fluid end need to be maintained and or removed. Thus, there is an ongoing need for improved pumps and methods of operation for pumps, allowing for more effective oilfield pumping operations in the face of such harsh operating conditions.

SUMMARY

The present application discloses, in one embodiment among others, a positive displacement wellbore servicing pump having a power end and a fluid end is disclosed. The fluid end has a main chamber and a suction bore in fluid connection with the main chamber and the suction bore has a suction central axis vector extending from an exterior suction bore end to an interior suction bore end. A discharge bore is in fluid connection with the main chamber and the discharge bore has a discharge central axis vector extending from an exterior discharge bore end to an interior discharge bore end. A portion of the suction central axis vector is vertically higher than any portion of the discharge central axis vector.

The present application also discloses a method of providing a wellbore servicing fluid to a wellbore. The method comprises locating a positive displacement wellbore servicing pump at a wellbore servicing site, preparing a source of wellbore servicing fluid, connecting the positive displacement pump in fluid connection with the source of wellbore servicing fluid through an exterior end of a suction bore, the exterior end being substantially located at a top of a fluid end of the positive displacement pump, and transferring wellbore servicing fluid from the source of wellbore servicing fluid to a wellbore through the suction bore.

Still further, the present application discloses a method of providing a wellbore servicing fluid to a fluid end of a positive displacement pump. This method comprises providing the wellbore servicing fluid to the fluid end with the assistance of gravity.

BRIEF DESCRIPTION OF THE DRAWINGS

For a more complete understanding of the present disclosure, and for further details and advantages thereof, reference is now made to the accompanying drawings, wherein.

DETAILED DESCRIPTION OF THE INVENTION

Figure 1:
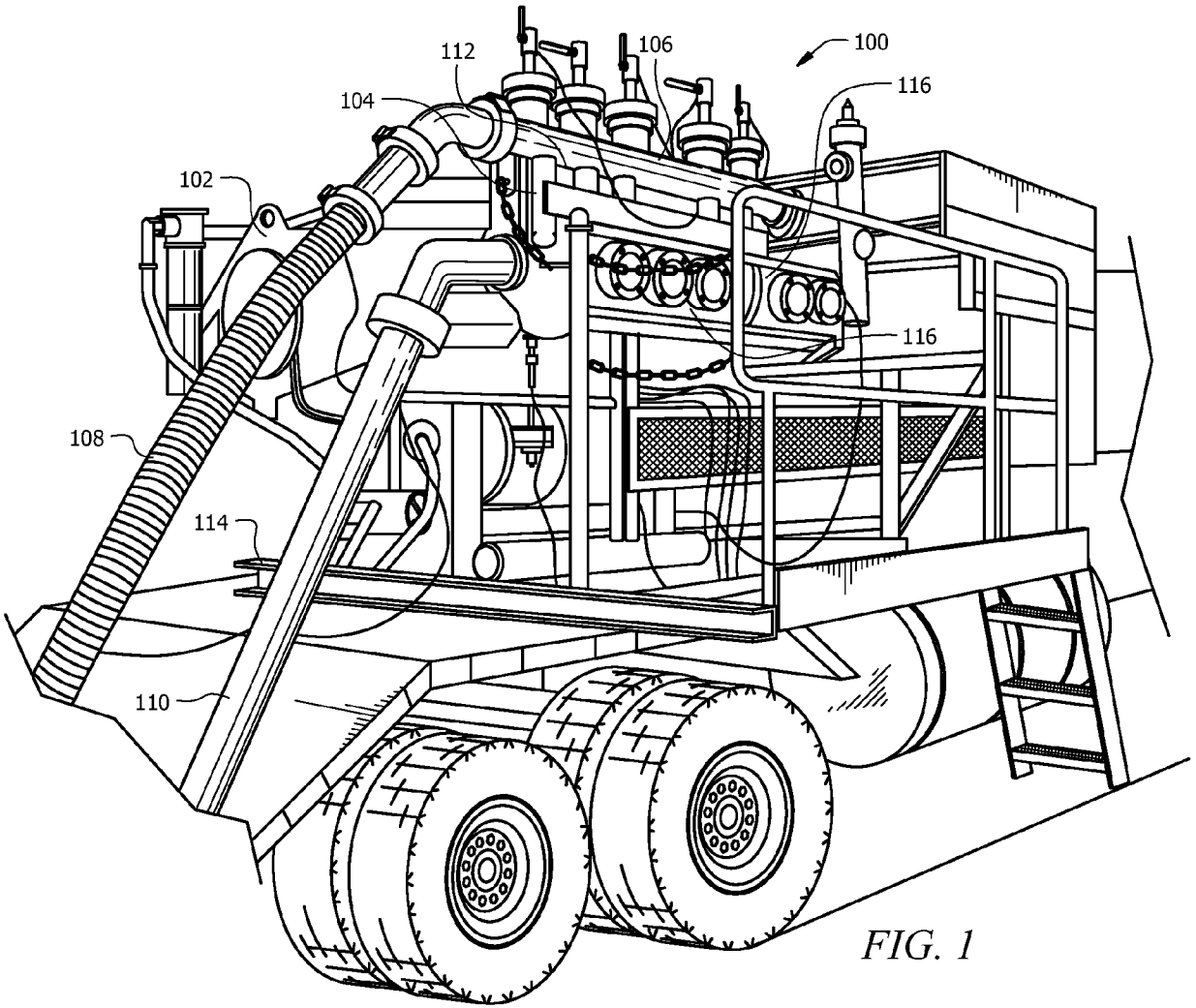
FIG. 1 is an oblique view of a pump according to an embodiment of the present invention.
Figure 2:
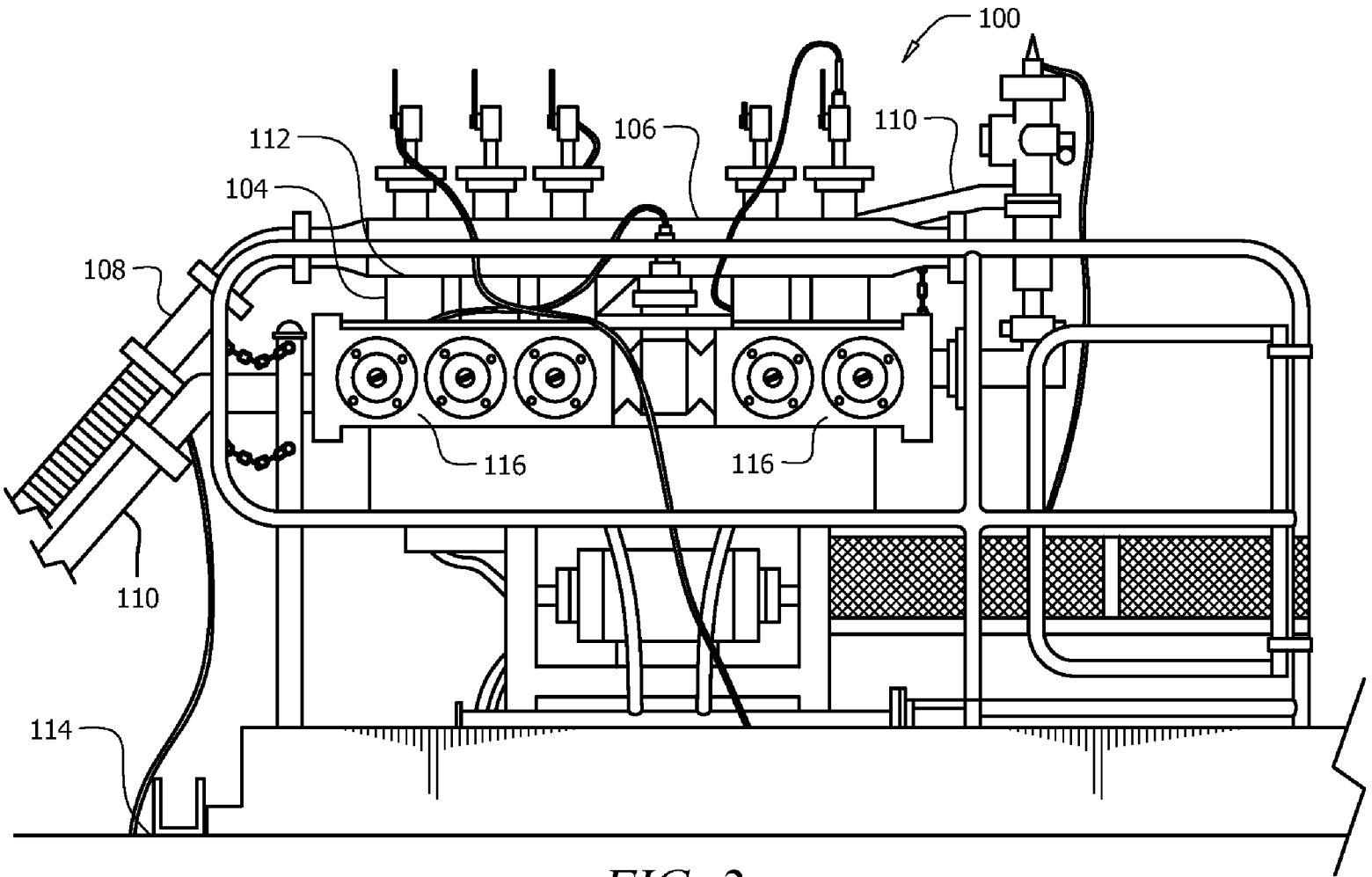
FIG. 2 is an orthogonal front view of the pump of FIG. 1.

Referring to FIGS. 1-2, a positive displacement wellbore servicing pump 100 (hereinafter referred to as "pump 100") according to an embodiment of the present invention is shown. Pump 100 generally comprises a power end 102, a fluid end 104, and a suction header 106. Fluid end 104 is connected to at least one input conduit 108 to supply fluid to the fluid end 104 from a fluid source and is also connected to at least one discharge conduit 110 to provide a path for the fluid to flow away from fluid end 104, sometimes into a wellbore. As used herein, the terms "higher" and "lower" are used in a comparative manner in which higher describes a position further from the earth's center of gravity than a relatively lower position that is nearer the earth's center of gravity. In other words, an object located at a higher position would have a higher gravitational potential energy than the same object if the object were located at a lower position. Generally, the term "top" is used to denote the highest portion of an object. For example, the fluid end 104 comprises a fluid end top 112 that is generally a portion of the fluid end 104 furthest from the earth's center of gravity when the pump 100 is in position for operation.

Pump 100 is shown as being supported (e.g., removably affixed) by a trailer 114. While association of pump 100 with a trailer such as trailer 114 may be advantageous for some applications, pump 100 may alternatively be assembled at a wellbore servicing site, simply delivered as a stand-alone unit (e.g., skid mounted) to a wellbore servicing site, or may be more fully and/or permanently integrated with other wellbore servicing equipment. However, with pump 100 being associated with trailer 114, some physical characteristics of pump 100 are accordingly more important than if pump 100 were not associated with the trailer 114. For example, when pump 100 is associated with or transported by a trailer 114, size, weight, and the center of gravity of the pump 100 are generally more important since those factors affect the handling of the trailer 114 during transport and the general portability of the pump 100.

Figure 3:
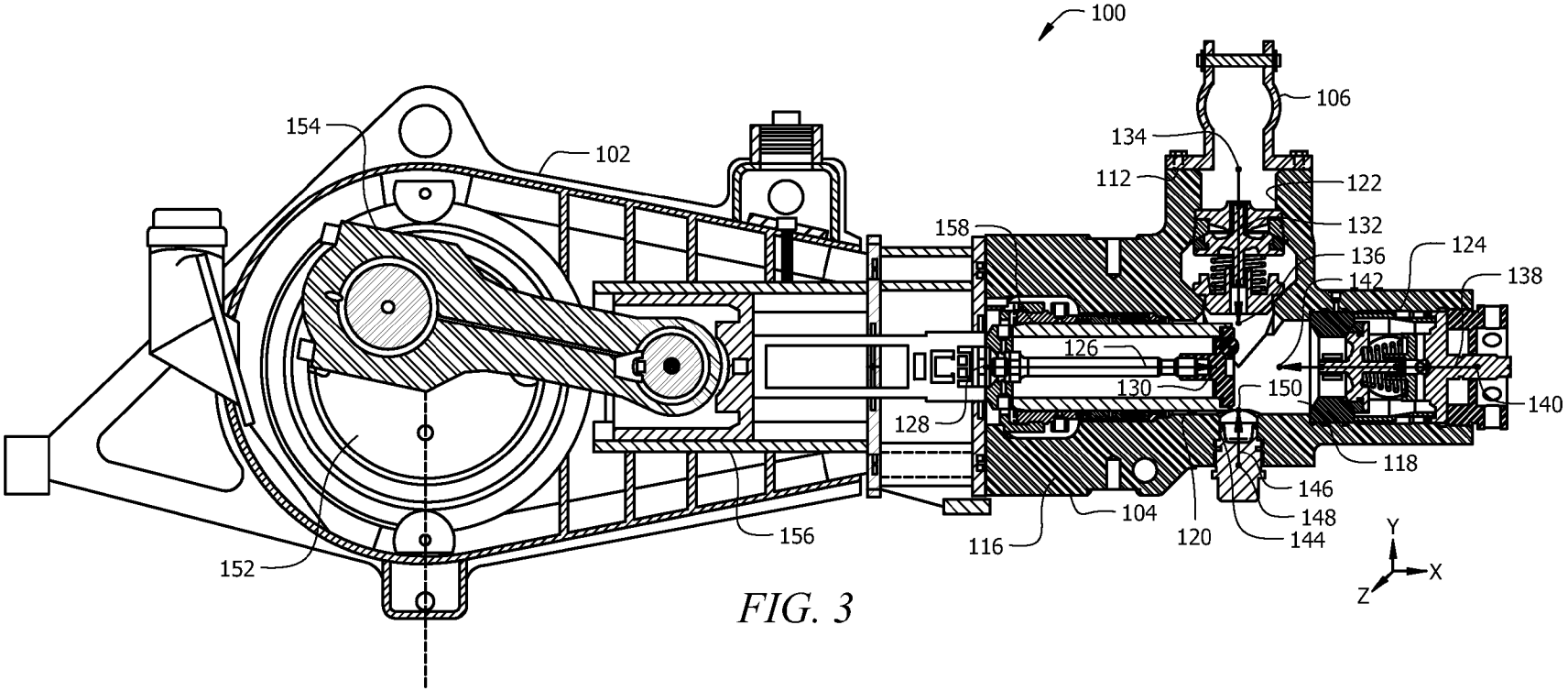
FIG. 3 is a cross-sectional view of the pump of FIG. 1.

Referring now to FIG. 3, a cross-sectional view of the pump 100 is shown. Fluid end 104 comprises a bore housing 116 which is connected to the power end 102 and also to the suction header 106. Bore housing 116 comprises a main chamber 118 in fluid communication with a displacement bore 120, a suction bore 122, and a discharge bore 124. Each bore 120, 122, 124 has an interior end adjacent and open to the main chamber 118 and an exterior end open to the exterior of the bore housing 116, thereby, each provides a fluid flow path into and/or out of the main chamber 118. Further, each bore 120, 122, 124 can be described as comprising a central axis vector along which components (discussed infra) generally move during operation of pump 100. Displacement bore 120 comprises a displacement central axis vector 126 with a displacement vector tail 128 located generally at an exterior end of the displacement bore 120 and a displacement vector head 130 located generally at an interior end of the displacement bore 120. Similarly, suction bore 122 comprises a suction central axis vector 132 with a suction vector tail 134 located generally at an exterior end of the suction bore 122 and a suction vector head 136 located generally at an interior end of the suction bore 122. Discharge bore 124 comprises a discharge central axis vector 138 with a discharge vector tail 140 located generally at an exterior end of the discharge bore 124 and a discharge vector head 142 located generally at an interior end of the discharge bore 124. Further, it is apparent that the bore housing 116 may comprise a plurality of sets of bores 120, 122, 124. As evident from FIG. 1, an embodiment of pump 100 has total of five sets of the bores 120, 122, 124 with three sets being housed within one housing 116 while the remaining two sets are housed within another housing 116. Of course, alternative embodiments of a pump may comprise more or fewer sets of bores 120, 122, 124 and with as few as a single set within a housing 116 and/or more than three sets within a housing 116.

In the embodiment of the fluid end 104 shown in FIG. 3, the displacement central axis vector 126 and the discharge central axis vector 138 are substantially coaxial and lie generally parallel to the x-axis of the shown coordinate system. In this embodiment, generally, movement along the y-axis of the coordinate system corresponds to the terms higher and lower as defined herein (commonly referred to as vertical movement), while the x-z plane is a horizontal plane generally tangential to the earth. However, the suction central axis vector 132 lies generally perpendicular to the x-axis (i.e., parallel with the y-axis) and the suction bore 122 is generally located, in the y-direction, between the displacement bore 120 and the discharge bore 124. This arrangement between the three bores 120, 122, 124 creates what may be called a "T-bore" arrangement where the displacement central axis vector 126, suction central axis vector 132, and discharge central axis vector 138 generally form a T-shaped layout along an x-y plane that is substantially orthogonal to the z-axis. In this embodiment, the suction central axis vector 132 lies entirely higher (i.e., in the y-direction) than any portion of the discharge central axis vector 138. Likewise, the interior end of the suction bore 122 (as indicated by the suction vector head 136) is about equal to or alternatively higher (i.e., in the y-direction) than the upper wall (i.e., in the y-direction) of displacement bore 120 and/or discharge bore 124, such that substantially all of the suction bore 122 lies above (i.e., in the y-direction) the displacement and discharge bores Further, the bore housing 116 comprises an access bore 144 comprising an access central axis vector 146. The access central axis vector 146 comprises an access vector tail 148 located generally at an exterior end of the access bore 144 and an access vector head 150 located generally at an interior end of the access bore 144. In this embodiment, the access central axis vector 146 is generally coaxial with the suction central axis vector 132 and is located lower (i.e., in the y-direction) than the suction central axis vector 132. Likewise, the interior end of the access bore 144 (as indicated by the access vector head 150) is about equal to or alternatively lower (i.e., in the y-direction) than the lower wall (i.e., in the y-direction) of displacement bore 120 and/or discharge bore 124, such that substantially all of the access bore 144 lies below (i.e., in the y-direction) the displacement and discharge bores.

Still referring to FIG. 3, power end 102 comprises a rotatable crankshaft 152 attached to a crank arm 154. Crank arm 154 is also attached to a plunger assembly 156 that comprises a plunger 158. Together, the crank arm 154 and plunger assembly 156 are configured to cause reciprocation of plunger 158 along a path generally parallel to the displacement central axis vector 126 (i.e., in the x-direction) in response to rotation of the crankshaft 152.

Figure 4:
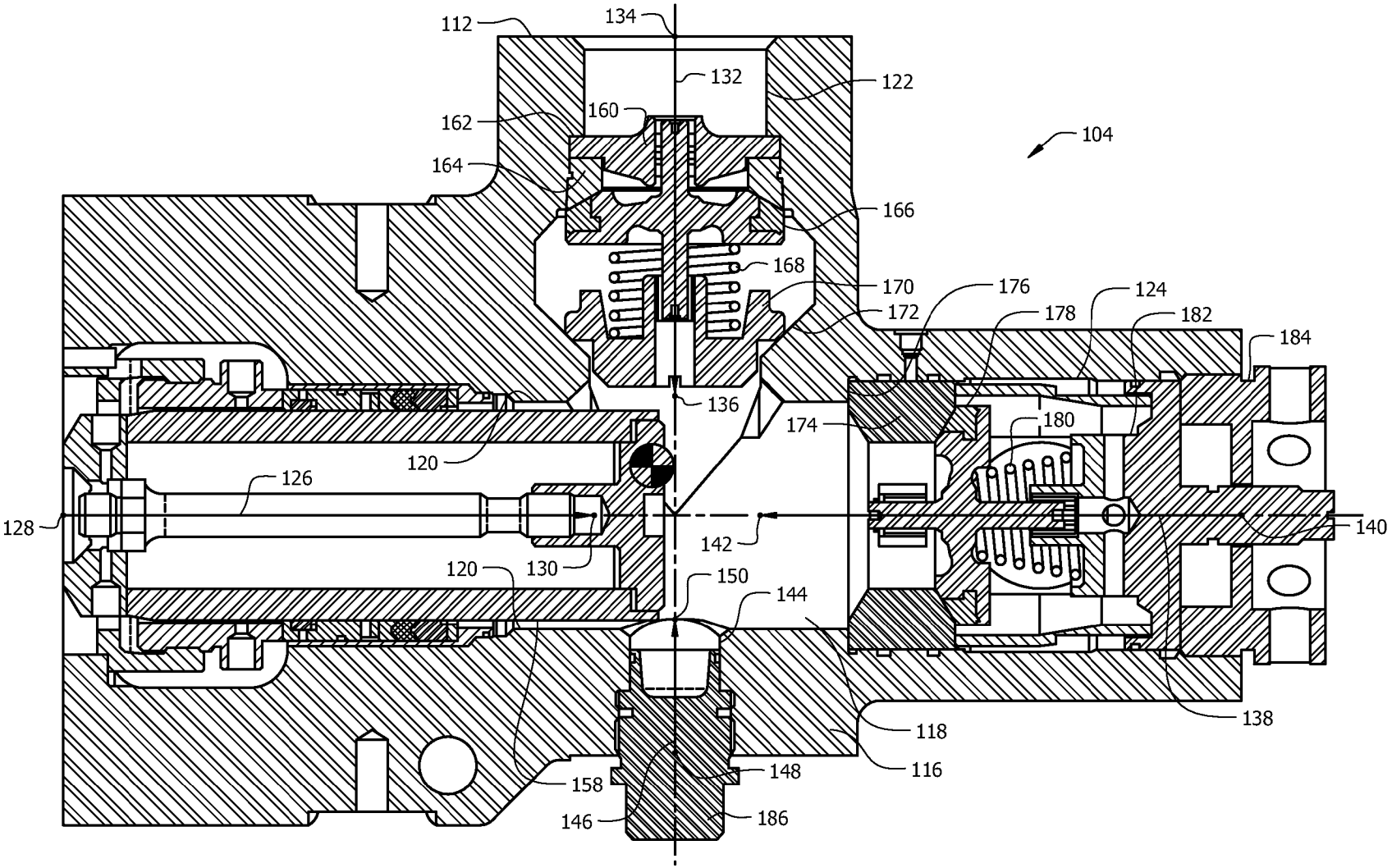
FIG. 4 is a cross-section view of a fluid end of the pump of FIG. 1.

Referring now to FIG. 4, the fluid end 104 is shown for clarity without connection to power end 102 or suction header 106, with the exception that the plunger 158 of power end 102 is shown within displacement bore 120. In this embodiment, a suction guide 160 is disposed with the suction bore 122 and abutted against a suction bore shoulder 162 of the suction bore 122. A suction valve seat 164 is abutted against the suction guide 160 and is located closer to the main chamber 118 than the suction guide 160. Further, a suction valve assembly 166 is located along the suction central axis vector 132 and is biased to contact the suction valve seat 164 from a position closer to the main chamber 118 than the suction valve seat 164. A suction valve spring 168 is compressed between the suction valve assembly 166 and a suction spring retainer 170 to bias the suction valve assembly 166 away from the suction spring retainer 170. The suction spring retainer 170 is abutted against and stopped by sloped retaining walls 172 of the suction bore 122. The suction valve assembly 166 is movable along the suction central axis vector 132 between a position in abutment against the suction valve seat 164 and a position in abutment against the suction spring retainer 170.

Still referring to FIG. 4, a discharge guide 174 is disposed within the discharge bore 124 and abutted against a discharge bore shoulder 176 of the discharge bore 124. Further, a discharge valve assembly 178 is located along the discharge central axis vector 138 and is biased to contact the discharge guide 174 from a position further from the main chamber 118 than the discharge guide 174. A discharge valve spring 180 is compressed between the discharge valve assembly 178 and a discharge spring retainer 182 to bias the discharge valve assembly 178 away from discharge spring retainer 182. The discharge spring retainer 182 is abutted against and stopped by a discharge cover 184 that is removable from the bore housing 116. The discharge valve assembly 178 is movable along the discharge central axis vector 138 between a position in abutment against the discharge guide 174 and a position in abutment against the discharge spring retainer 182. Further, plunger 158 is movable along the displacement central axis vector 126 while a removable access plug 186 obstructs the access bore 144.

In operation of pump 100, the plunger 158 is reciprocated to alternate between providing suction strokes and discharge strokes. During the suction stroke, the suction valve assembly 166 should be open (with the suction valve assembly 166 away from the suction valve seat 164), allowing fluid from the suction header 106 to enter the main chamber 118 through the suction bore 122. The discharge valve assembly 178 of pump 100 would be closed under the influence of discharge valve spring 180 and line pressure during the suction stroke. Pressure in the main chamber 118 will vary during suction and discharge strokes depending upon the position of the plunger 158 in the displacement bore 120 and the amount and type of fluid (and/or other material) in the main chamber 118. During the discharge stroke, the suction valve assembly 166 should generally be closed against the suction valve seat 164, preventing fluid in the main chamber 118 from exiting via the suction bore 122 so that as pressure in the main chamber 118 builds (due to compression by the plunger 158), the discharge valve assembly 178 opens (as the discharge valve spring 180 is compressed), and fluid in the main chamber 118 is pumped under pressure out the discharge bore 124 and into a discharge conduit 110.

Figure 5:
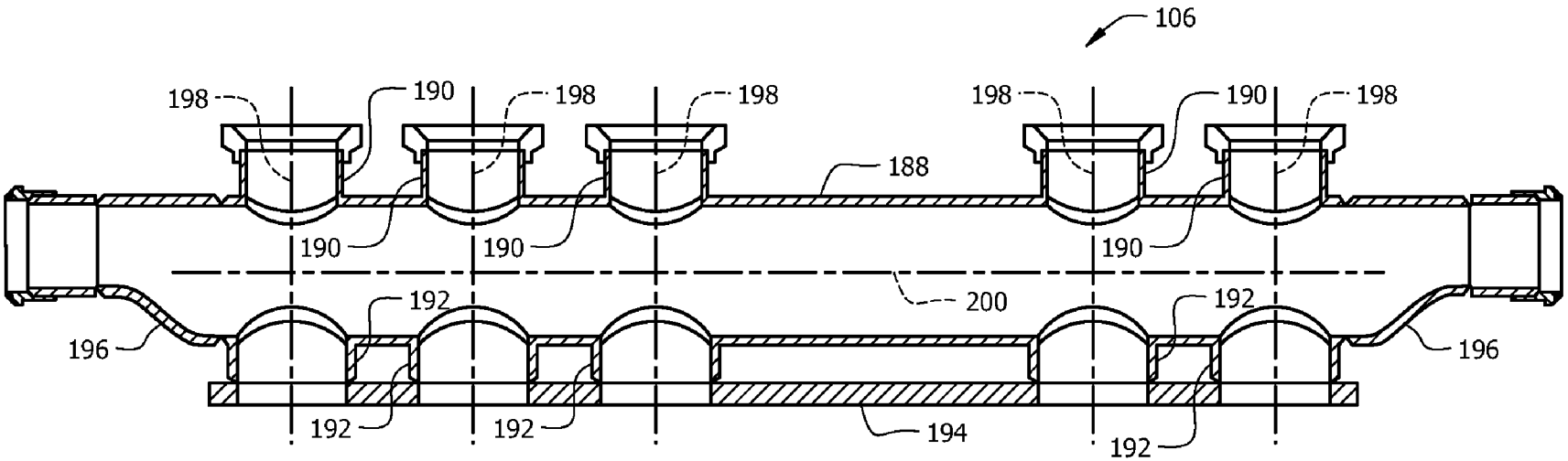
FIG. 5 is cross-sectional view of a suction header of the pump of FIG. 1.

Referring now to FIG. 5, a cross-sectional view of the suction header 106 is shown for clarity without connection to the fluid end 104 or input conduit 108. Suction header 106 generally comprises a main tube 188 connected to upper risers 190 (or flanges) and lower risers 192 (or flanges). The lower risers 192 connect (e.g., via welds) the main tube 188 to a mount plate 194. The suction header 106 may comprise optional adapter ends 196 for connecting the suction header 106 to input conduits 108 where the input conduits 108 have smaller connection diameters than the diameter of the main tube 188. Upper risers 190 may be sealed with simple plate-like caps (e.g., flange plates) or may be fitted with other caps with attached access or sampling hardware such as valves for selectively accessing the contents of the suction header 106. In this embodiment, each lower riser 192 is associated with a separate and corresponding upper riser 190. Specifically, the lower riser 192 and associated upper riser 190 of a pair are generally located coaxial along a riser axis 198. The riser axes 198 lie generally perpendicular to a main tube axis 200. The suction header 106 is connected to the fluid end 104 by passing bolts through apertures in the mount plate 194 and thereafter securing the bolts within apertures of the bore housing 116. When the suction header 106 is connected to the fluid end 104, the interiors of each of the main tube 188, upper risers 190, lower risers 192, adapter ends 196, and the suction bores 122 are in fluid connection.

Figure 6:
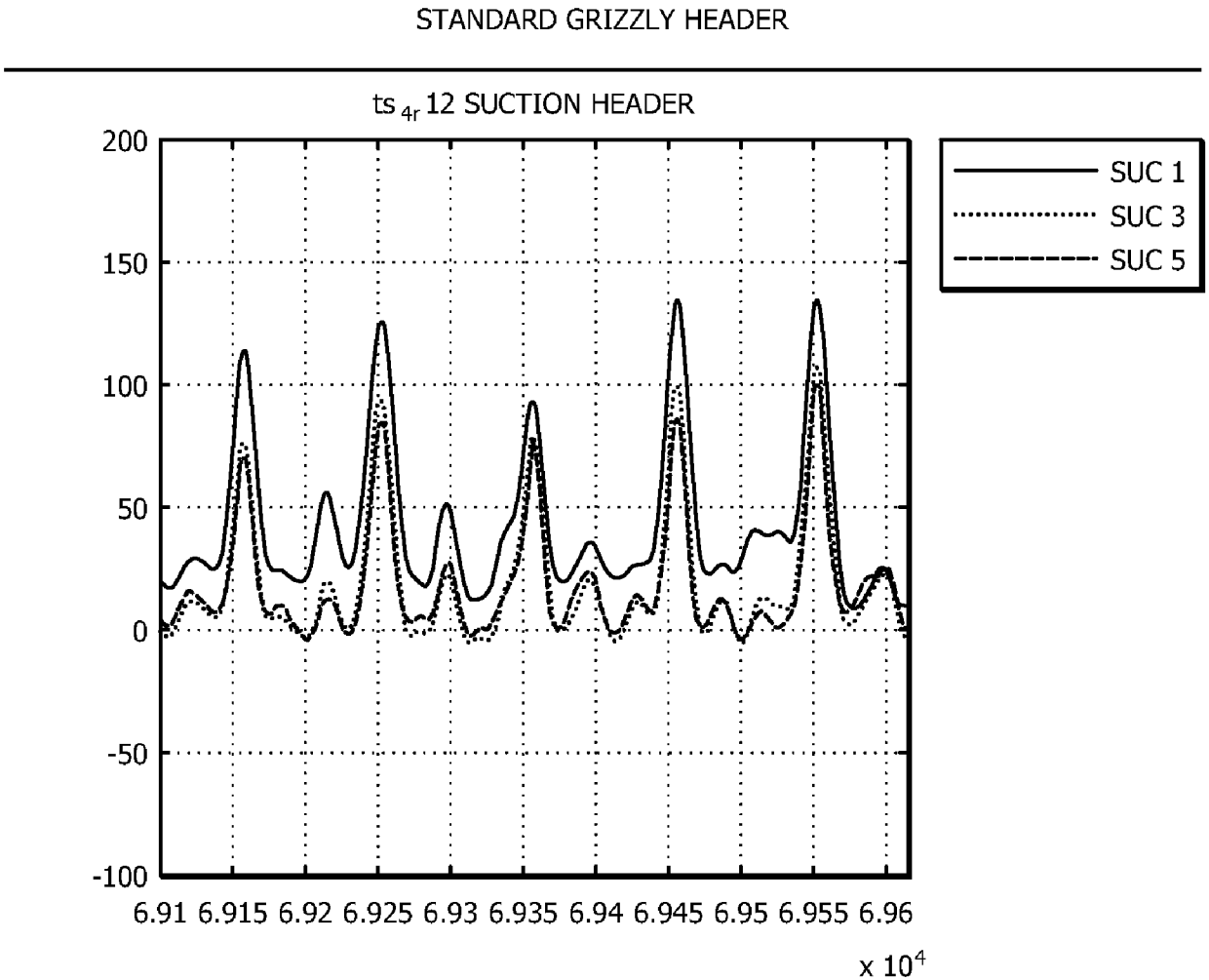
FIG. 6 is a graph showing the relatively high variations in fluid pressure when using a conventional suction header with the fluid end of the pump of FIG. 1.
Figure 7:
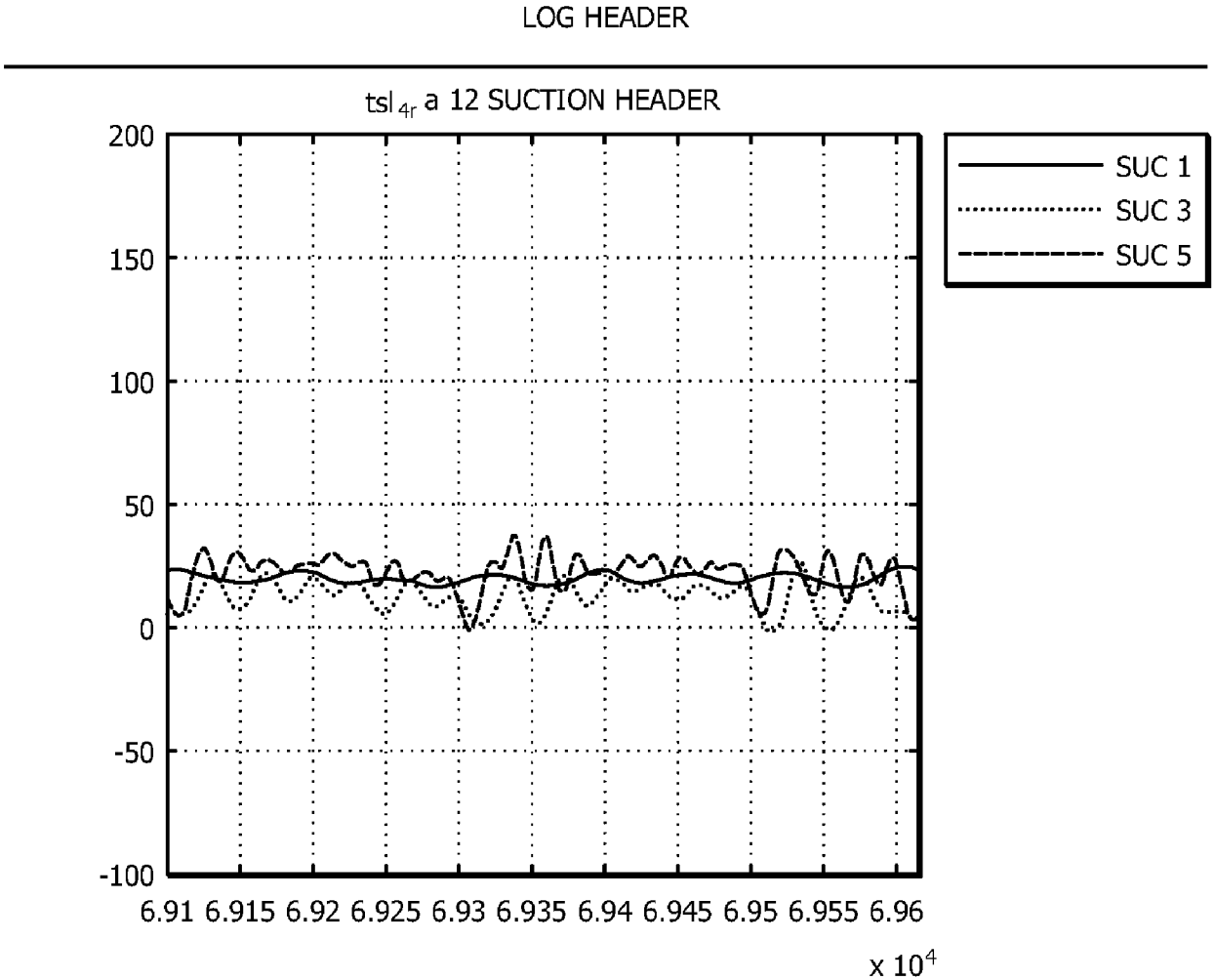
FIG. 7 is a graph showing the relatively low variations in fluid pressure when using the suction header and fluid end of the pump of FIG. 1.

Suction header 106 serves not only as a convenient manifold for distributing fluid to the suction bores 122, but also aids in prevention of suction cavitation. Specifically, the suction header 106 is sized to have an internal volume which effectively acts as an accumulator for lowering pressure variations related to the suction portion of the fluid end 104. Specifically, FIG. 6 shows that when a fluid end 104 is operated with a conventional suction header, pressure variations throughout the pumping cycles may vary between −5 and 125. However, FIG. 7 shows that when a fluid end 104 is operated with the suction header 106, the pressure variations throughout the pumping cycles vary significantly less, even up to 68% less. With the lower variations in pressure, cavitation is less likely, component wear is reduced, and pumping is accomplished more efficiently.

Further, the size of the suction header, particularly, the diameter of the main tube 188 is derived by computational fluid dynamics techniques to minimize pressure variations while also preventing the physical size of the suction header 106 from interfering with assembly/disassembly of the suction header 106 to the fluid end 104. The computational fluid dynamics techniques are implemented to reduce weight since the suction header 106 is located higher than the fluid end 104 and significantly contributes to causing a higher center of gravity of the pump 100 and to further aid in reducing transportation weight. Still further, the computational fluid dynamics techniques are used to optimize the suction header 106 for minimizing proppant settling within the suction header 106. Particularly, proppant laden fluids can be described as having a settling velocity. If a proppant laden fluid is moved at a velocity lower than the settling velocity, the proppants of the mixture tend to settle and accumulate, effectively separating from the remainder of the mixture. Of course, the settling velocity for a fluid mixture depends on at least the size and density of the proppants as well as the density of the fluids in which the proppants are carried. Accordingly, the suction header 106 is of a size selected to provide fluid flow within the suction header 106 at or above the settling velocity of commonly used proppant laden wellbore servicing fluid mixtures.

Still further, the suction header 106 balances the need between providing flow rates through the suction header 106 higher than the settling velocity and the need to reduce wear on components of the pump 100. Wear can be a major concern for pumps, especially when pumping abrasive fluid, since it may reduce the service life of a pump. Additionally, cavitation resulting in a water-hammer effect that generates potentially destructive impact forces on the internal components of a pump 100 can be problematic. The suction header 106 alleviates these problems by acting as both a fluid reservoir and as an accumulator. Particularly, since the suction header 106 holds a larger volume of fluid than a conventional header, more fluid is readily available for transport through suction bores 122 and such transfer occurs at a lower pressure since the diameter of the main tube 188 is large relative to both the suction bore 122 diameter and the diameter of the input conduit 108. The cross-sectional area of the main tube 188 taken along a plane substantially perpendicular to its lengthwise central axis is approximately 43% larger than a similar cross-sectional area of a conventional header. Generally, lower fluid velocity and lower pressure within the pump 100 reduces wear and minimizes cavitation (since larger flow area and the lower fluid velocity reduce opportunities for formation of a gas pocket). Further, fluid being assisted by gravity to flow from the suction header 106 via the lower risers 192 into the suction bores 122 provides an additional opening force on the suction valve assembly 166, allowing the suction valve assembly 166 to open more quickly, thereby reducing wear and minimizing cavitation. The suction header 106 provides a large enough diameter of the main tube 188 so that fluid velocities are lowered in comparison to conventional systems (e.g., in this embodiment, approximately 43% lower than in conventional headers), thereby reducing damage and wear to components associated with the suction header 106 and suction bore 122.

Another feature of the suction header 106 is that due to the suction header being located higher than the fluid end 104, specifically higher than the suction bores 122, any inadvertent settling of proppants from the mixtures within the suction header 106 poses no risk of undue accumulation. Instead of proppants accumulating and thereafter causing pump 100 to fail, the proppants which may settle naturally (possibly due to transitional startups or shut-downs of the pump 100), and with the aid of gravity, fall through the lower risers 192 into suction bores 122. The settled proppants enter the main chamber 118 through the suction bore 122 and are reintegrated into the fluid mixture and pumped out the discharge bore 124. Another feature of the suction header 106 is that the suction header 106 provides the accumulator and shock absorption benefits without having to be tuned to a specific flow rate, fluid pressure, or fluid mixture.

Further, in an alternative use of the pump 100 when using the pump 100 to pump a heavy slurry, the suction header 106 may be connected to a recirculating pump to improve proppant suspension. In this use, the recirculating pump (optionally a boost pump) may be connected to the adapter ends 196 so that recirculation flow is generally maintained at a desired velocity, even if the direction of such fluid flow is generally along the length of the main tube 188 in the circulatory loop that includes the recirculation pump.

Another feature of the pump 100 is that installation and removal of the components associated with the suction bore 122 are simplified and require less physical force. Particularly, with regard to installing the suction guide 160 and suction valve seat 164, it is helpful if the suction central axis vector 132 and the access central axis vector 146 are coaxial, as is shown in some embodiments such as FIG. 8. To install the suction guide 160 and suction valve seat 164 (while the fluid end 104 is attached to the power end 102), the access plug 186 is removed from the access bore 144. Also, the discharge cover 184 is removed followed by removal of the discharge spring retainer 182, the discharge valve assembly 178, and the discharge guide 174. With those components removed, the main chamber 118 can be accessed through both the access bore 144 and the discharge bore 124. Generally, the suction guide 160 and the suction valve seat 164 are passed through the discharge bore 124, into the main chamber 118, and then into the suction bore 122. Next, a hammering plunger inserted through the access bore 144 and the suction valve seat 164 is hammered into place with the hammering plunger. Next, the suction valve spring 168 and suction spring retainer 170 are placed within the main chamber 118 and supported by a T-handle tool that is passed through the access bore 144 in the same manner as the hammering plunger. Finally, the components are pressed into place within the suction bore 122 and the suction spring retainer 170 is caused to engage the retaining walls 172 of the suction bore 122.

The design of the fluid end 104 allows removal of the components within the suction bore 122 with significantly less force than if the suction bore 122 were not located above the discharge bore 124 and with at least some vertical component to the associated suction central axis vector 132. Specifically, since the suction bore 122 has the suction vector tail 134 (and hence, the exterior end of the suction bore 122) located at the fluid end top 112, the difficulty of hammering the components of the suction bore 122 out of the suction bore 122 is greatly reduced. To remove the suction bore 122 components, the components of the discharge bore 124 are removed as explained above and the access plug 186 is removed. Next, any caps preventing access to the interior of the upper riser 190 is removed to allow access to the suction bores 122 through the suction header 106 along the riser axis 198. Prior to removal of the suction guide 160, the suction spring retainer 170, suction valve spring 168, and suction valve assembly 166 are removed by using the T-handle tool in a manner similar to that described above. Next, to remove the suction guide 160 (which after the pump 100 has been operated is tightly lodged within the suction bore 122 against the suction bore shoulder 162) a driver, a rod, and a hammer are used to hammer downward onto the suction guide 160 through the suction header 106 and the exterior side of the suction bore 122 at the fluid end top 112. Once loosened, the suction guide 160 can be removed from the fluid end 104 through the discharge bore 124. It is important to note that since the suction central axis vector 132 is comprised primarily of a vertical component and originates at the fluid end top 112, the hammering of the suction guide 160 is much easier than attempting to dislodge the suction guide 160 from below as is the case in some other fluid ends. In fact, it is estimated that the dislodging of the suction guide 160 can be accomplished in only about 25% of the time required to remove other suction guides where the other suction guides must be removed from below.

Figure 8:
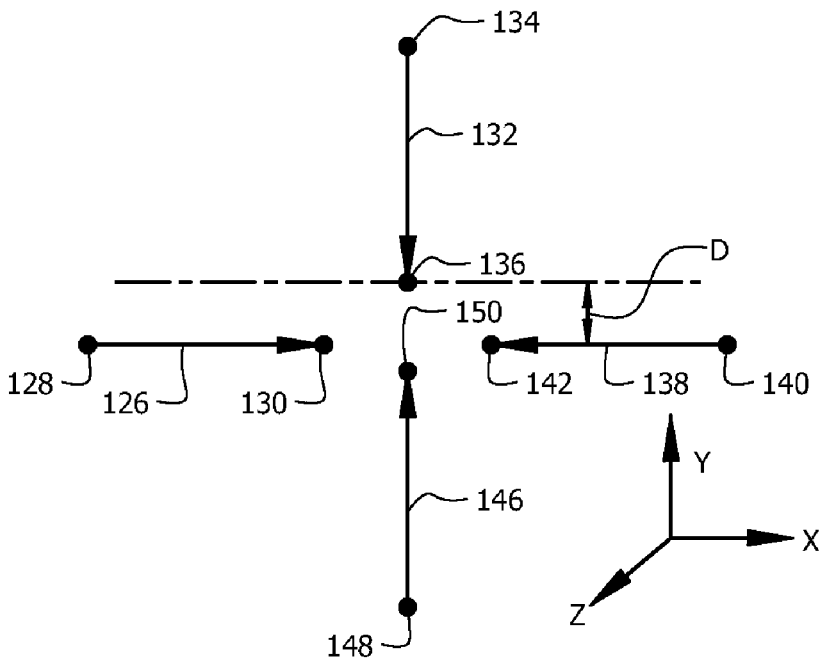
FIG. 8 is a schematic view of the fluid end of the pump of FIG. 1.

Referring now to FIG. 8, a simplified diagram shows the placement and configuration of displacement bore 120, suction bore 122, discharge bore 124, and access bore 144 within fluid end 104 with reference to the positioning of the displacement central axis vector 126, suction central axis vector 132, discharge central axis vector 138, and access central axis vector 146, respectively. In this embodiment, the displacement central axis vector 126 and the discharge central axis vector 138 are generally coaxial. Further, in this embodiment, the suction central axis vector 132 and the access central axis vector 146 are generally coaxial. Finally, the suction central axis vector 132 is substantially perpendicular to the discharge central axis vector 138, with the suction vector head 136 being located a distance D vertically higher (i.e., in the y-direction) than the discharge central axis vector 138. It will be appreciated that the suction bore 122 is considered to be higher than the discharge bore 124 when any portion of the suction central axis vector 132 lies higher (i.e., in the y-direction) than any portion of the discharge central axis vector 138. Accordingly, suction bore 122 is considered to be higher than discharge bore 124. The orientation of FIG. 8 is further shown in more detail in FIGS. 3 and 4.

Figure 9:
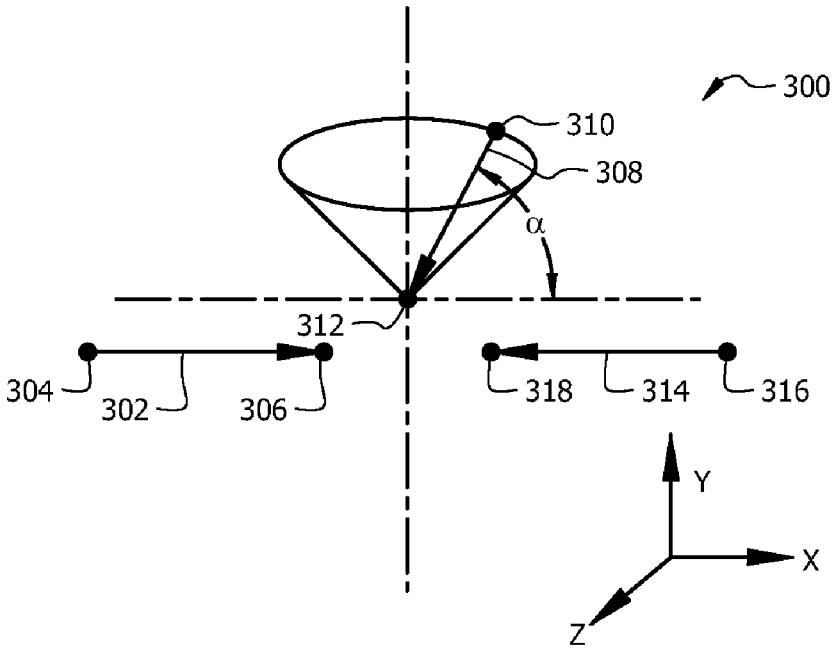
FIG. 9 is a schematic view of an alternative embodiment of a fluid end.

However, it will be appreciated that many orientations and locations of a suction bore may allow for a suction bore to be higher than a discharge bore while still providing a suction central axis vector with a vertical component. Referring now to FIG. 9, a fluid end 300 comprises a displacement central axis vector 302 (having a displacement vector tail 304 and a displacement vector head 306), a suction central axis vector 308 (having a suction vector tail 310 and a suction vector head 312), and a discharge central axis vector 314 (having a discharge vector tail 316 and a discharge vector head 318). In this embodiment, generally, movement along the y-axis of the coordinate system corresponds to the terms higher and lower as defined herein (commonly referred to as vertical movement), while the x-z plane is a horizontal plane generally tangential to the earth. However, FIG. 9 illustrates that the suction central axis vector 308 may be oriented to have any positive angle value $\alpha$ ($\alpha>0$) as measured between the suction central axis vector 308 and a plane parallel to the x-z plane. Further, the suction vector tail 310 and the suction vector head 312 may or may not have the same z-axis values. As shown, the suction vector tail 310 has a lower value (i.e., in the z-direction) than the suction vector head 312. Of course, in alternative embodiments, the suction vector tail may have a higher value than the suction vector head.

Figure 10:
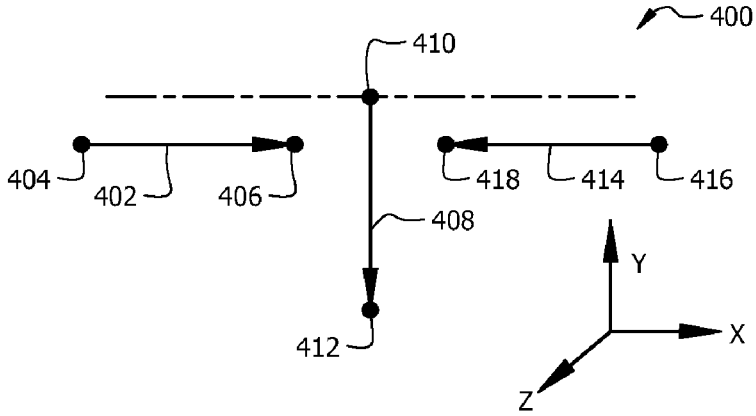
FIG. 10 is a schematic view of another alternative embodiment of a fluid end.

Referring now to FIG. 10, a fluid end 400 comprising a displacement central axis vector 402 (having a displacement vector tail 404 and a displacement vector head 406), a suction central axis vector 408 (having a suction vector tail 410 and a suction vector head 412), and a discharge central axis vector 414 (having a discharge vector tail 416 and a discharge vector head 418) is shown. In this embodiment, generally, movement along the y-axis of the coordinate system corresponds to the terms higher and lower as defined herein (commonly referred to as vertical movement), while the x-z plane is a horizontal plane generally tangential to the earth. Displacement central axis vector 402 and discharge central axis vector 414 may be substantially coaxial. FIG. 10 illustrates that a portion of the suction central axis vector 408 may be located lower (i.e., in the y-direction) than the discharge central axis vector 414. However, since at least the suction vector tail 410 is located higher than the entire discharge central axis vector 414, the suction central axis vector 408 is considered to be higher than the discharge central axis vector 414. Depending upon the y-direction location of the suction vector tail 410 relative to the discharge central axis vector 414, greater than 10%, 25%, 50%, 75%, 90%, 99% or substantially all of the suction central axis vector 408 may be located higher (i.e., in the y-direction) than the discharge central axis vector 414.

Figure 11:
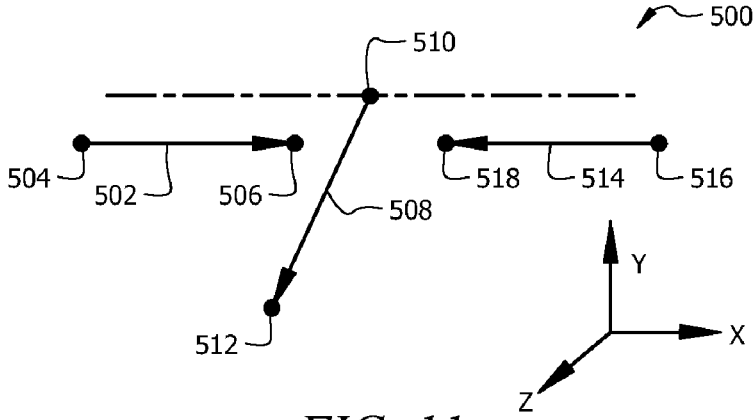
FIG. 11 is a schematic view of another alternative embodiment of a fluid end.

Referring now to FIG. 11, a fluid end 500 comprising a displacement central axis vector 502 (having a displacement vector tail 504 and a displacement vector head 506), a suction central axis vector 508 (having a suction vector tail 510 and a suction vector head 512), and a discharge central axis vector 514 (having a discharge vector tail 516 and a discharge vector head 518) is shown. In this embodiment, generally, movement along the y-axis of the coordinate system corresponds to the terms higher and lower as defined herein (commonly referred to as vertical movement), while the x-z plane is a horizontal plane generally tangential to the earth. Displacement central axis vector 502 and discharge central axis vector 514 may be substantially coaxial. FIG. 11 illustrates that a portion of the suction central axis vector 508 may be located lower than the discharge central axis vector 514 while the suction central axis vector 508 is oriented other than orthogonal to or parallel to a plane parallel to the x-z plane. Here again, since at least the suction vector tail 510 is located higher than all of the discharge central axis vector 514, the suction central axis vector 508 is considered to be higher than the discharge central axis vector 514.

Figure 12:
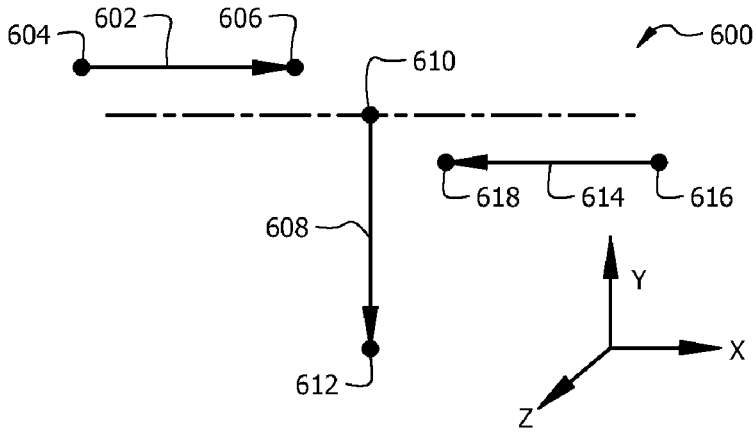
FIG. 12 is a schematic view of another alternative embodiment of a fluid end.

Referring now to FIG. 12, a fluid end 600 comprising a displacement central axis vector 602 (having a displacement vector tail 604 and a displacement vector head 606), a suction central axis vector 608 (having a suction vector tail 610 and a suction vector head 612), and a discharge central axis vector 614 (having a discharge vector tail 616 and a discharge vector head 618) is shown. In this embodiment, generally, movement along the y-axis of the coordinate system corresponds to the terms higher and lower as defined herein (commonly referred to as vertical movement), while the x-z plane is a horizontal plane generally tangential to the earth. FIG. 12 illustrates that the entire suction central axis vector 608 may be located lower than the displacement central axis vector 602. Regardless, since at least the suction vector tail 610 is located higher (i.e., in the y-direction) than the entire discharge central axis vector 614, the suction central axis vector 608 is considered to be higher than the discharge central axis vector 614.

It will be appreciated that while particular embodiments have been described above as having a particular orientation with respect to the shown coordinate systems (in which the y-axis is associated with vertical displacement), any embodiment described or contemplated herein may be rotated in space relative to the coordinate systems described while still allowing the suction central axis vector to comprise a vertical component. In other words, even if the described embodiments are not located in space with respect to the described coordinate systems as specified, many orientations exist where the embodiment maintains functionality and where the suction bore is located higher than the discharge bore.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Accordingly, the scope of protection is not limited by the description set out above, but is defined by the claims which follow, that scope including all equivalents of the subject matter of the claims. Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings refer to a "Field of the Invention," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. The term "comprising" as used herein is to be construed broadly to mean including but not limited to, and in accordance with its typical usage in the patent context, is indicative of inclusion rather than limitation (such that other elements may also be present). In all instances, the scope of the claims shall be considered on their own merits in light of this disclosure, but should not be constrained by the headings set forth herein.

What is claimed is:

1. A positive displacement wellbore servicing pump having a power end and a fluid end, the fluid end comprising:

a main chamber;

a suction bore in fluid connection with the main chamber, the suction bore comprising a suction central axis vector extending from an exterior suction bore end to an interior suction bore end;

a suction header having a main tube with a main tube axis and a lower riser connected between the main tube and a mount plate, the lower riser having a riser axis substantially perpendicular to the main tube axis, and the lower riser providing a fluid connection between the main tube and the suction bore; and a discharge bore in fluid connection with the main chamber, the discharge bore comprising a discharge central axis vector extending from an exterior discharge bore end to an interior discharge bore end;

wherein at least a portion of the suction central axis vector is vertically higher than any portion of the discharge central axis vector.

2. The positive displacement wellbore servicing pump of claim 1, wherein the discharge central axis is substantially perpendicular to the suction central axis vector.

3. The positive displacement wellbore servicing pump of claim 1, wherein the suction bore exterior end is substantially located at a top of the fluid end.

4. The positive displacement wellbore servicing pump of claim 1, further comprising:

a suction header having a main tube in fluid connection with the suction bore, the suction header being sized and shaped so that proppants that settle from fluid within the suction header settle into the suction bore.

5. The positive displacement wellbore servicing pump of claim 1, further comprising:

an access bore having an access central axis vector extending from an exterior access bore end to an interior access bore end;

wherein the access central axis vector is substantially coaxial with the suction central axis vector.

6. The positive displacement wellbore servicing pump of claim 1, further comprising:

a displacement bore having a displacement central axis vector extending from an exterior displacement bore end to an interior displacement bore end;

wherein the displacement central axis vector is substantially perpendicular to the suction central axis vector.

7. The positive displacement wellbore servicing pump of claim 6, wherein the discharge central axis vector is substantially perpendicular to the suction central axis vector and the discharge central axis vector is substantially coaxial with the displacement central axis vector.

8. The positive displacement wellbore servicing pump of claim 1, further comprising:

an upper riser connected to the main tube, the upper riser being coaxial with the riser axis.

9. A method of providing a wellbore servicing fluid to a wellbore, comprising:

locating the positive displacement wellbore servicing pump of claim 1 at a wellbore servicing site;

preparing a source of wellbore servicing fluid;

connecting the positive displacement pump in fluid connection with the source of wellbore servicing fluid through an exterior end of the suction bore, the exterior end of the suction bore being substantially located at a top of a fluid end of the positive displacement pump; and transferring the wellbore servicing fluid from the source of wellbore servicing fluid to a wellbore through the suction bore.

10. The method according to claim 9, wherein the wellbore servicing fluid is a particle laden fluid.

11. The method according to claim 9, wherein the wellbore servicing fluid is a fracturing fluid.

12. The method according to claim 9, wherein the transferring of wellbore servicing fluid through the exterior end of the suction bore is assisted by gravity.

13. The method according to claim 9, further comprising:

transferring the wellbore servicing fluid through a suction header prior to transferring the wellbore servicing fluid through the suction bore, wherein the transferring of the wellbore servicing fluid from the suction header to the suction bore is assisted by gravity.

14. The method according to claim 9, further comprising:

transferring the wellbore servicing fluid through the suction header prior to transferring the wellbore servicing fluid through the suction bore, wherein some wellbore servicing fluid is recirculated through the suction header during the transferring of some of the wellbore servicing fluid from the suction header to the suction bore.

15. A method of providing a wellbore servicing fluid to the fluid end of the positive displacement pump of claim 1, comprising:

providing the wellbore servicing fluid to the fluid end with the assistance of gravity.

16. The method of claim 15, further comprising:

moving a suction valve assembly of the positive displacement pump to an open position using gravitational potential energy of the wellbore servicing fluid.

17. The method of claim 15, wherein the wellbore servicing fluid provided to the fluid end is positively pressurized while being provided to the fluid end.

18. The positive displacement pump of claim 1, further comprising a trailer supporting the pump.

19. The positive displacement pump of claim 18, further comprising a discharge conduit coupled to the discharge bore end of the pump and in fluid connection with a wellbore, thereby providing for transfer of a wellbore servicing fluid from the pump to the wellbore.

20. A positive displacement wellbore servicing pump having a power end and a fluid end, the fluid end comprising:

a main chamber;

a suction bore in fluid connection with the main chamber, the suction bore comprising a suction central axis vector extending from an exterior suction bore end to an interior suction bore end;

a discharge bore in fluid connection with the main chamber, the discharge bore comprising a discharge central axis vector extending from an exterior discharge bore end to an interior discharge bore end; and a displacement bore in fluid connection with the main chamber, the displacement bore comprising a displacement central axis vector extending from an exterior displacement bore end to an interior displacement bore end, wherein at least a portion of the suction central axis vector is vertically higher than any portion of the discharge central axis vector, wherein the displacement central axis vector is substantially perpendicular to the suction central axis vector, and wherein the discharge central axis vector is substantially perpendicular to the suction central axis vector and the discharge central axis vector is substantially coaxial with the displacement central axis vector.

* * * * *